US009795844B1

(12) United States Patent
Dacey et al.

(10) Patent No.: US 9,795,844 B1
(45) **Date of Patent: *Oct. 24, 2017**

(54) PUTTER-TYPE GOLF CLUB HEAD WITH SOUND CHAMBER

(71) Applicant: Callaway Golf Company, Carlsbad, CA (US)

(72) Inventors: Kevin P. Dacey, La Jolla, CA (US); Craig E. Abbott, Vista, CA (US); Augustin W. Rollinson, Carlsbad, CA (US); Brandon D. DeMille, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 77 days.

This patent is subject to a terminal disclaimer.

(21) Appl. No.: 14/825,811

(22) Filed: Aug. 13, 2015

Related U.S. Application Data

(63) Continuation-in-part of application No. 14/662,400, filed on Mar. 19, 2015, now Pat. No. 9,526,952.

(60) Provisional application No. 62/048,094, filed on Sep. 9, 2014.

(51) Int. Cl.
*A63B 53/00* (2015.01)
*A63B 53/04* (2015.01)

(52) U.S. Cl.
CPC ..... *A63B 53/0487* (2013.01); *A63B 53/007* (2013.01); *A63B 2053/042* (2013.01); *A63B 2053/0408* (2013.01); *A63B 2053/0416* (2013.01); *A63B 2053/0458* (2013.01)

(58) Field of Classification Search
CPC ..... A63B 53/0487; A63B 2053/0416; A63B 2053/0408; A63B 53/007; A63B 53/065; A63B 2053/042; A63B 2053/0425; A63B 2053/0429; A63B 2053/0458
USPC ..... 473/324–350, 287–292, 219–256
See application file for complete search history.

(56) References Cited

U.S. PATENT DOCUMENTS 4,113,249 A * 9/1978 Beery ..... A63B 53/0487 473/329
4,872,683 A * 10/1989 Doran ..... A63B 53/04 473/249
5,160,144 A * 11/1992 Maniatis ..... A63B 53/0487 473/234
5,322,285 A * 6/1994 Turner ..... A63B 53/007 473/313
5,346,219 A * 9/1994 Pehoski ..... A63B 53/0487 473/325

(Continued)

*Primary Examiner* — Sebastiano Passaniti
(74) *Attorney, Agent, or Firm* — Rebecca Hanovice; Michael Catania; Sonia Lari

(57) ABSTRACT

A putter-type golf club head with a sound chamber is disclosed herein. The club head comprises a body and a two-piece face insert disposed over the sound chamber. The sound chamber comprises a central sound sub-chamber and an outer sound sub-chamber, while the face insert comprises a first, metallic piece that includes a central recess, which is filled with a second, polymeric piece. The metallic piece is welded to the body, and the polymeric piece is adhered to the metallic piece. The body also includes at least one through-bore extending from the sound chamber through a back wall of the body. The body, the sound chamber, the face insert, and the through-bore amplify the sound generated by the putter-type golf club head striking a golf ball.

18 Claims, 10 Drawing Sheets

(56) References Cited

U.S. PATENT DOCUMENTS 5,431,396 A * 7/1995 Shieh ..... A63B 53/04 473/329
5,447,311 A * 9/1995 Viollaz ..... A63B 53/04 473/329
5,551,694 A * 9/1996 Grim, Jr. ..... A63B 53/0487 473/234
6,095,931 A * 8/2000 Hettinger ..... A63B 53/0487 473/341
6,270,423 B1 * 8/2001 Webb ..... A63B 53/0487 473/226
6,860,822 B2 * 3/2005 Vrska, Jr. ..... A63B 53/0487 473/324
7,112,147 B2 * 9/2006 Solheim ..... A63B 53/0487 473/340
7,118,493 B2 * 10/2006 Galloway ..... A63B 53/02 473/224
7,273,420 B2 * 9/2007 Wright ..... A63B 53/0487 473/329
7,309,296 B2 * 12/2007 Souza ..... A63B 53/0487 473/329
7,354,355 B2 * 4/2008 Tavares ..... A63B 53/04 473/329
7,393,287 B2 * 7/2008 Huang ..... A63B 53/04 473/329
8,070,623 B2 * 12/2011 Stites ..... A63B 53/0466 473/329
8,617,001 B2 * 12/2013 Sandoval ..... A63B 53/04 473/340
8,641,556 B2 * 2/2014 Kuan ..... A63B 53/0487 473/340
8,684,860 B2 * 4/2014 Rollinson ..... A63B 53/007 473/329
8,840,489 B2 * 9/2014 Del Rosario ..... A63B 53/0487 473/329
8,915,798 B2 * 12/2014 Hocknell ..... A63B 53/04 473/329
9,517,394 B1 * 12/2016 Dacey ..... A63B 53/0487
2008/0108452 A1 * 5/2008 Chiang ..... A63B 53/0466 473/329

* cited by examiner

PUTTER-TYPE GOLF CLUB HEAD WITH SOUND CHAMBER

CROSS REFERENCES TO RELATED APPLICATIONS

The present invention is a continuation-in-part of U.S. patent application Ser. No. 14/662,400, filed on Mar. 19, 2015, and issued on Dec. 27, 2016, as U.S. Pat. No. 9,526,952, and claims priority to U.S. Provisional Patent Application No. 62/048,094, filed on Sep. 9, 2014, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a putter-type golf club head. More specifically, the present invention relates to a putter-type golf club head with a sound chamber to affect the sound when the putter-type golf club head strikes a golf ball.

Description of the Related Art

The prior art discloses various golf club heads that have been modified to influence the sound of club head impacting a golf ball. For example, Beery, U.S. Pat. No. 4,113,249, for a Golf Club And Manufacture Thereof, discloses a golf club head with a sound chamber and a plastic insert covering the sound chamber in order to minimize dampening of sound frequencies. Maniatis, U.S. Pat. No. 5,160,144, for a Golf Putter Including Tuning Fork Effects, discloses a putter head with a vertical slice to create a tuning fork effect. Turner, U.S. Pat. No. 5,322,285, for a Golf Putter, discloses a putter with a low frequency (below 2500 Hz) sound. Pehoski et al., U.S. Pat. No. 5,346,219, for a Golf Putter Head, discloses a putter head that generates a ringing sound when a golf ball is struck. Grim, Jr. et al., U.S. Pat. No. 5,551,694, for a Sounding Golf Putter, discloses a putter head with sound producing tines. Wright et al., U.S. Pat. No. 7,086,961, for a Method And Apparatus For Using A Frequency Selectable Insert In A Golf Club Head, discloses an insert composed of a plate, a dampener and a mass. Tavares et al., U.S. Pat. No. 7,354,355, for a Golf Club Head Or Other Ball Striking Device With Modifiable Feel Characteristics, discloses a putter head with openings in which elements are placed to change the feel and sound of the putter head. However, there is still a need for a putter with improved sound when it strikes a golf ball.

BRIEF SUMMARY OF THE INVENTION

The present invention is a putter with a better sound when impacting a golf ball.

One aspect of the present invention is a putter-type golf club head comprising a body with a heel end, a toe end, an aft end, a face portion, a crown portion and a sole portion, the body defining a sound chamber adjacent an opening in the face portion, and a face insert positioned within the opening, the face insert comprising a first piece having a central recess and a second piece disposed within the central recess, wherein the second piece is composed of a polymeric material, and wherein the body, the sound chamber and the face insert amplify the sound generated by the putter-type golf club head striking a golf ball. The sound chamber may have a volume ranging from 0.25 cubic inches to 0.95 cubic inches, and may comprise a central sound sub-chamber and at least one outer sound sub-chamber. In some embodiments, a volume of the central sound sub-chamber may be greater than a volume of the outer sound sub-chamber. The body may be composed of an iron alloy material, and the first piece of the face insert may be composed of a metal material and be welded to the body. The face insert may have a variable face thickness, and may have a return portion and a striking plate portion. In some embodiments, the face insert may have a cross-bar pattern with a thick cross bar and a plurality of thin sections, and a thickness of the cross bar may be at least 0.03 inch greater than a thickness of each of the plurality of thin sections.

Another aspect of the present invention is a putter-type golf club head comprising a body with a heel end, a toe end, an aft end, a face portion, a rear surface opposite the face portion, a crown portion and a sole portion, the body defining a sound chamber adjacent an opening in the face portion and at least one through bore extending from the sound chamber through the rear surface, and a face insert positioned within the opening, wherein the body, the sound chamber, the through bore, and the face insert amplify the sound generated by the putter-type golf club head striking a golf ball. The face insert may comprise a first piece comprising a central recess and a second piece disposed within the central recess, the first piece may be composed of a metal material and be welded to the body, and the second piece may be composed of a polymeric material and be affixed to the first piece with an adhesive material. In some embodiments, the body may have a volume ranging from 2.3 cubic inches to 2.8 cubic inches, and in others the body may be composed of an iron alloy material. In some embodiments, the at least one through bore may comprise two through bores, and the sound chamber may comprise a central sound sub-chamber and at least one outer sound sub-chamber.

Yet another aspect of the present invention is a putter-type golf club head comprising a body defining a sound chamber adjacent an opening in a face portion and at least one through-bore extending from the sound chamber through a rear surface of the body, the sound chamber comprising a central sound sub-chamber and at least one outer sound sub-chamber, and a face insert positioned within the opening, the face insert having a central section and a plurality of thin sections, wherein a thickness of the central section is at least 0.03 inch greater than a thickness of each of the plurality of thin sections, wherein the body, the sound chamber, the through-bore, and the face insert amplify the sound generated by the putter-type golf club head striking a golf ball. The face insert may have a return portion and a striking plate portion, and the sound chamber may have a volume ranging from 0.25 cubic inches to 0.95 cubic inches. In some embodiments, the body may have a volume ranging from 2.3 cubic inches to 2.8 cubic inches, and in others the face insert may be welded to the body.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
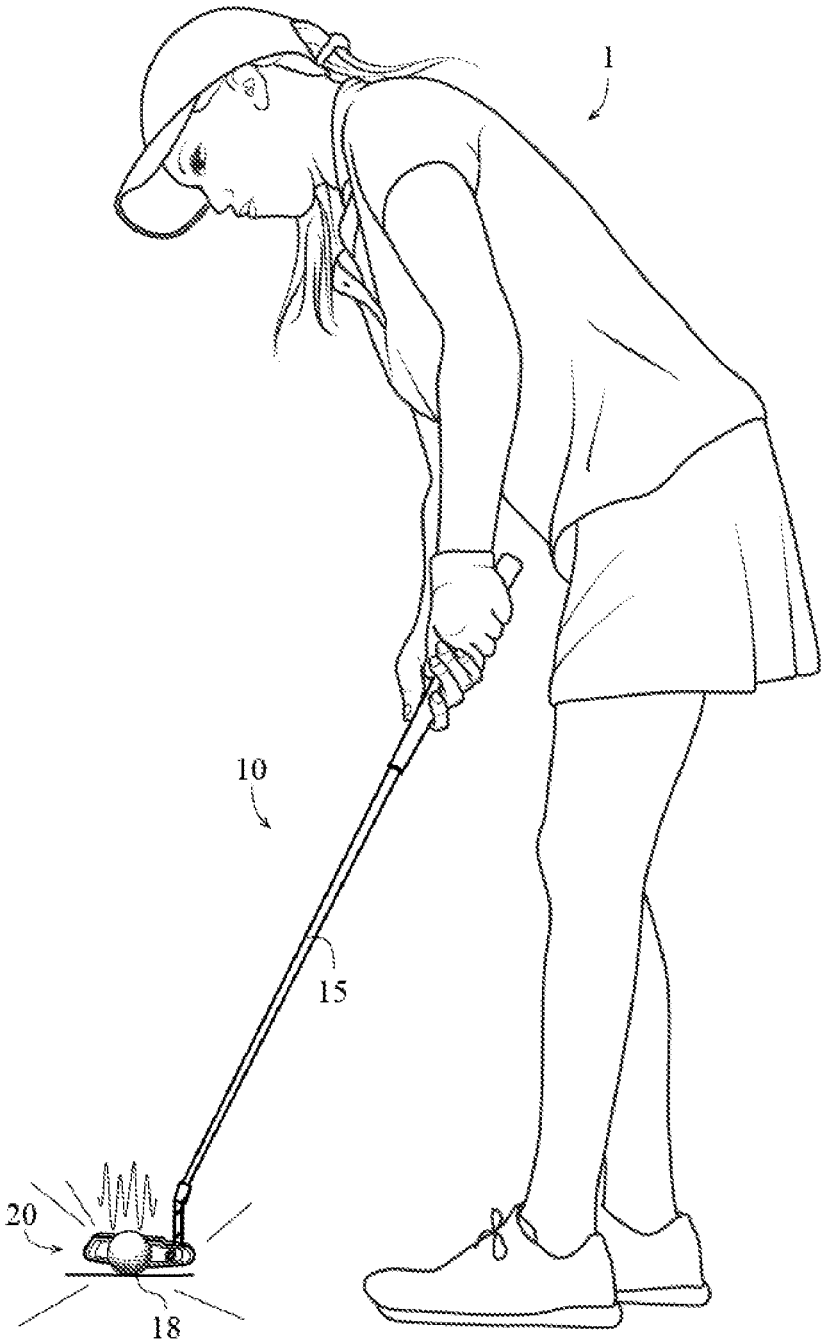
FIG. 1 is an illustration of a golfer striking a golf ball with a putter having a putter-type golf club head with a sound chamber.

As shown in FIG. 1, a golfer 1 strikes a golf ball 18 with a putter 10 having a shaft 15 and club head 20. The impact generates a sound, which is heard by the golfer. The putter-type club head 20 with a sound chamber amplifies the sound.

Figure 2A:
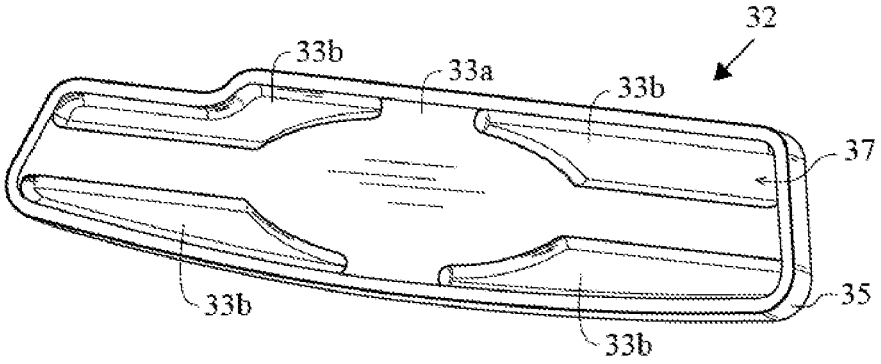
FIG. 2A is an isolated top perspective view of a first embodiment of a face insert for a putter-type golf club head.

As shown in FIG. 2A, a first embodiment of a face insert 32 has an internal surface with a cross bar pattern having a cross bar thick section 33*a* and four thin sections 33*b*. The cross bar thick section 33*a* preferably has a thickness ranging from 0.05 inch to 0.11 inch, and most preferably has a thickness of 0.09 inch. Each of the thin sections 33*b* preferably has a thickness ranging from 0.02 inch to 0.075 inch, and most preferably has a thickness of 0.05 inch. The thickness of the cross bar thick section 33*a* is at least 0.03 inch greater than a thickness of each of the thin sections 33*b*. The face insert 32 preferably has a return portion 35 and a striking plate portion 37. The return portion 35 preferably has a thickness ranging from 0.075 inch to 0.125 inch, and most preferably a thickness of 0.10 inch. The cross bar thick section 33*a* and four thin sections 33*b* are part of the striking plate portion 37. The face insert is preferably composed of a metal material such as an aluminum alloy, an iron alloy, a titanium alloy, tin, bronze, and the like.

Figure 2B:
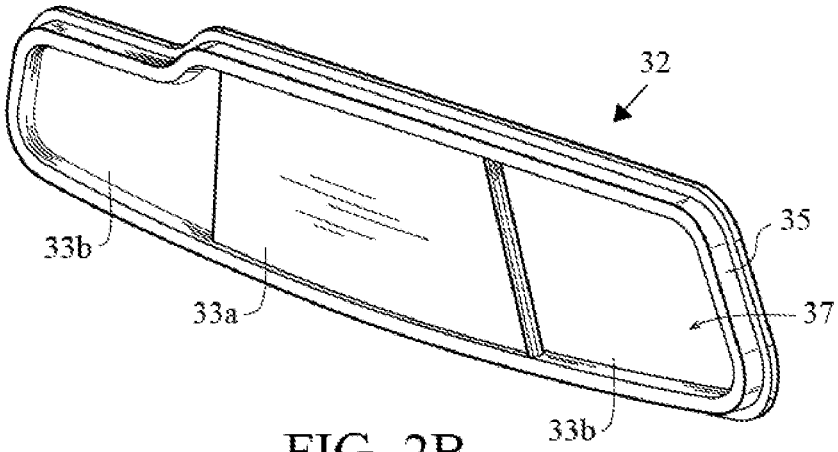
FIG. 2B is an isolated top perspective view of an alternative embodiment of a face insert for a putter-type golf club head.

As shown in FIG. 2B, a second embodiment of a face insert 32 has an internal surface with a thick central section 33*a* and two thin side sections 33*b*. The thick central section 33*a* preferably has a thickness ranging from 0.05 inch to 0.11 inch, and most preferably has a thickness of 0.09 inch. Each of the thin sections 33*b* preferably has a thickness ranging from 0.02 inch to 0.075 inch, and most preferably has a thickness of 0.05 inch. The thickness of the thick central section 33*a* is at least 0.03 inch greater than a thickness of each of the thin sections 33*b*. The face insert 32 preferably has a return portion 35 and a striking plate portion 37. The return portion 35 preferably has a thickness ranging from 0.075 inch to 0.125 inch, and most preferably a thickness of 0.10 inch. The cross bar thick section 33*a* and four thin sections 33*b* are part of the striking plate portion 37. The face insert is preferably composed of a metal material such as an aluminum alloy, an iron alloy, a titanium alloy, tin, bronze, and the like.

Those skilled in the pertinent art will recognize that other face inserts may be utilized with the putter-type club head having a sound chamber without departing from the scope and spirit of the invention. An example of such an insert is disclosed in Hocknell et al, U.S. Pat. No. 8,915,798, for a Putter Face Insert, which is hereby incorporated by reference in its entirety. Another example of such an insert is disclosed in Del Rosario et al, U.S. Pat. No. 8,840,489, for a Putter Face Insert, which is hereby incorporated by reference in its entirety. Yet another example of such an insert is disclosed in Rollinson, U.S. Pat. No. 8,684,860, for a Putter Face Insert, which is hereby incorporated by reference in its entirety.

Figure 3:
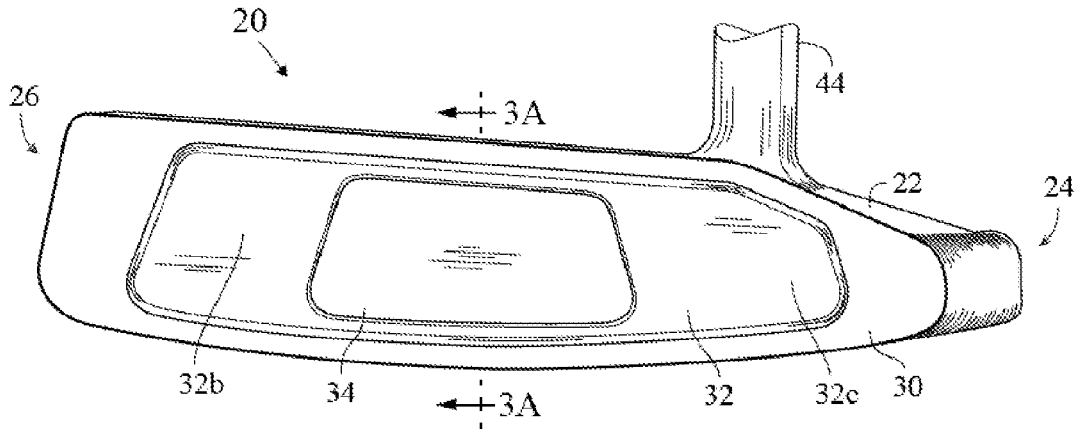
FIG. 3 is a front elevation view of a preferred embodiment of a putter-type golf club head with a sound chamber.
Figure 3A:
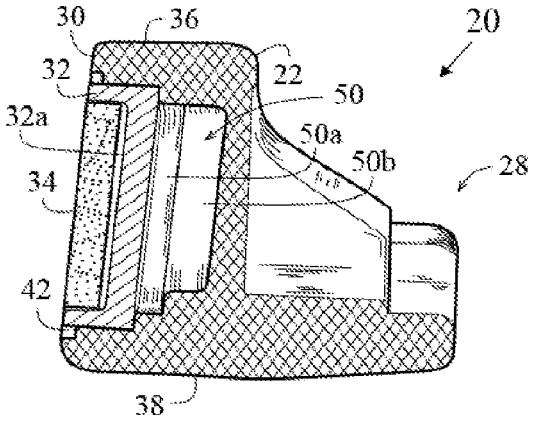
FIG. 3A is a cross-sectional view of a putter-type golf club head with a sound chamber along line A-A of FIG. 3.

As shown in FIGS. 3 and 3A, a preferred putter-type club head 20 comprises a body 22 and a face insert 32 disposed over a sound chamber 50. The body 22 comprises a heel end 24, a toe end 26, an aft end 28, a face portion 30, a crown portion 36 and a sole portion 38. The body 22 defines the sound chamber 50, which is adjacent to and communicates with an opening 42 in the face portion 30. The sound chamber 50 comprises a central sound sub-chamber 50*b* and an outer sound sub-chamber 50*a*. In this embodiment, the central sound sub-chamber 50*b* has a larger volume than the outer sound sub-chamber 50*a*. The body 22 preferably has a volume ranging from 2.3 cubic inches to 2.8 cubic inches, and most preferably has a volume of 2.52 cubic inches. The sound chamber 50 preferably has a volume ranging from 0.25 cubic inches to 0.95 cubic inches, and most preferably 0.41 cubic inches.

The face insert 32 is positioned within the opening 42 and preferably is composed of steel, and more preferably 17-4 stainless steel. As shown in FIG. 3A, no portion of the face insert 32 is disposed within the sound chamber 50. Though the face insert 32 may be affixed within the opening 42 with an adhesive, it preferably is welded to the body 22 to further improve the sound of the putter head 20 when it strikes a golf ball 18. In this embodiment, the face insert 32 has a recess 32*a* in a central area of a striking surface that is sized to receive an inner insert 34 composed of a soft, polymeric material such as urethane. The inner insert 34 preferably makes up between 10 and 30%, and more preferably approximately 20%, of the total volume of the face insert 32 and inner insert 34 combination. The toe and heel sections 32*b*, 32*c* of the face insert 32 are preferably 0.100 to 0.200 inch thick, and more preferably approximately 0.150 inch thick, the recessed area 32*a* is preferably 0.020 to 0.080 inch thick, and more preferably approximately 0.060 inch thick, and the face insert 32 is 3 to 4 inches wide, and more preferably approximately 3.5 inches wide. The inner insert 34 is approximately 0.050-0.100 inch thick, and more preferably approximately 0.075 inch thick, and approximately 1 to 2 inches wide, and is preferably permanently adhered within the face insert 32 with an adhesive such as VHB™ tape.

The putter-type golf club head 20 preferably has a pitch ranging from 2400 Hertz (Hz) to 2700 Hz. The putter-type golf club head 20 preferably has an amplitude ranging from 61.5 to 64.5 dBA (A weighted decibels, dBA, are an expression of the relative loudness of sounds in air as perceived by the human ear). The putter-type golf club head 20 preferably has a duration ranging from 25 milliseconds to 45 milliseconds.

A back wall thickness of the sound chamber 50 preferably ranges from 0.045 inch to 0.070 inch, and more preferably from 0.055 inch to 0.060 inch, and most preferably is 0.058 inch. The back wall of the sound chamber 50 extends from the rearmost point of the central sound sub-chamber 50*b* to the exterior surface of a rear wall of the body 22.

Figure 4:
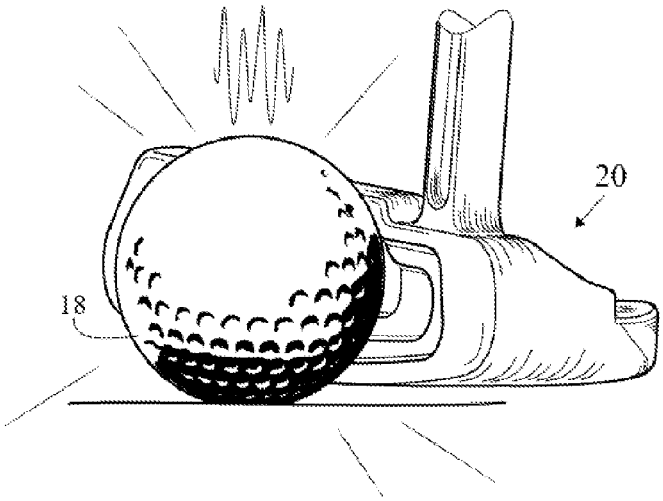
FIG. 4 is an illustration of a golf ball impacting a face of a putter-type golf club head having a sound chamber.

FIG. 4 illustrates a golf ball 18 impacting a face of a putter-type golf club head 20 having a sound chamber.

Figure 5:
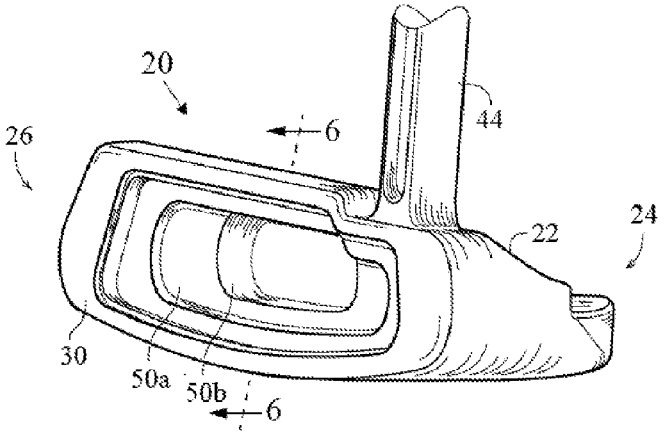
FIG. 5 is a front elevation view of a putter-type golf club head with a sound chamber with a face insert removed to illustrate the sound chamber.
Figure 6:
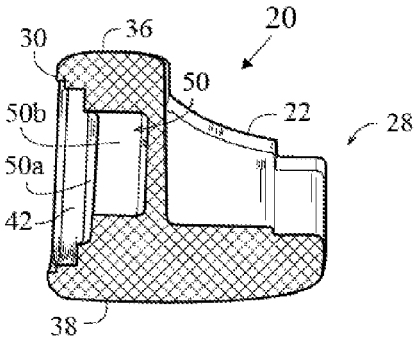
FIG. 6 is a cross-sectional view of a putter-type golf club head with a sound chamber along line 6-6 of FIG. 5.

FIGS. 5 and 6 illustrate an alternative embodiment of a putter-type golf club head 20 with a sound chamber 50. The body 22 comprises a heel end 24, a toe end 26, an aft end 28, a face portion 30, a crown portion 36 and a sole portion 38. A hosel 44 extends upward from a heel end 24 of the crown portion 36 of the body 22. The body 22 defines the sound chamber 50, which is adjacent to and communicates with an opening 42 in the face portion 30. The sound chamber 50 comprises a central sound sub-chamber 50*b* and an outer sound sub-chamber 50*a*. In this embodiment, the central sound sub-chamber 50*b* has a larger volume than the outer sound sub-chamber 50*a*. The body 22 preferably has a volume ranging from 2.3 cubic inches to 2.8 cubic inches, and most preferably has a volume of 2.52 cubic inches. The sound chamber 50 preferably has a volume ranging from 0.25 cubic inches to 0.75 cubic inches, and most preferably 0.41 cubic inches. This embodiment of the putter-type golf club head 20 preferably has a pitch of 2550 Hz, an amplitude of 63 dBA and a duration of 30 milli-seconds.

Figure 7:
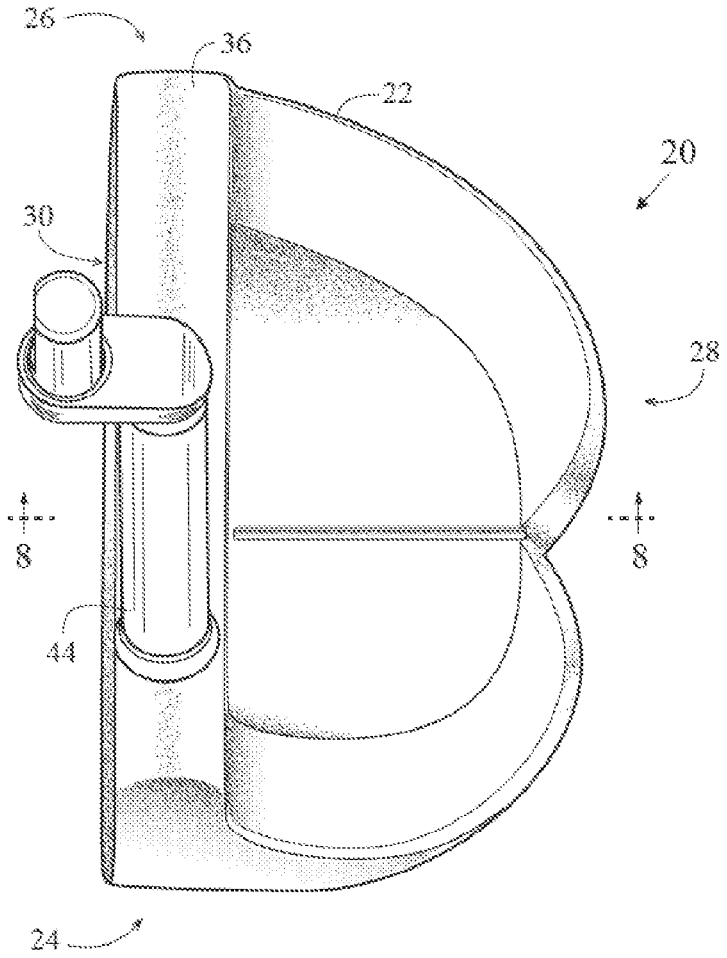
FIG. 7 is a top plan view of a putter-type golf club head with a sound chamber.
Figure 8:
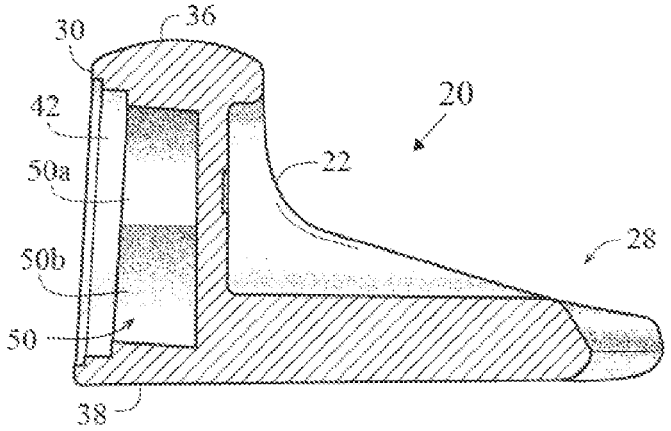
FIG. 8 is a cross-sectional view of a putter-type golf club head with a sound chamber along line 8-8 of FIG. 7.

FIGS. 7 and 8 illustrate an alternative embodiment of a putter-type golf club head 20 with a sound chamber 50. The body 22 comprises a heel end 24, a toe end 26, an aft end 28, a face portion 30, a crown portion 36 and a sole portion 38. A hosel 44 extends upward from a heel end 24 of the crown portion 36 of the body 22. The body 22 defines the sound chamber 50, which is adjacent to and communicates with an opening 42 in the face portion 30. The sound chamber 50 comprises a central sound sub-chamber 50*b* and an outer sound sub-chamber 50*a*. In this embodiment, the central sound sub-chamber 50*b* has a larger volume than the outer sound sub-chamber 50*a*. The body 22 preferably has a volume ranging from 2.3 cubic inches to 2.8 cubic inches, and most preferably has a volume of 2.42 cubic inches. The sound chamber 50 preferably has a volume ranging from 0.5 cubic inches to 0.95 cubic inches, and most preferably 0.84 cubic inches. This embodiment of the putter-type golf club head 20 preferably has a pitch of 2700 Hz, an amplitude of 64.5 dBA and a duration of 35 milli-seconds.

Figure 9:
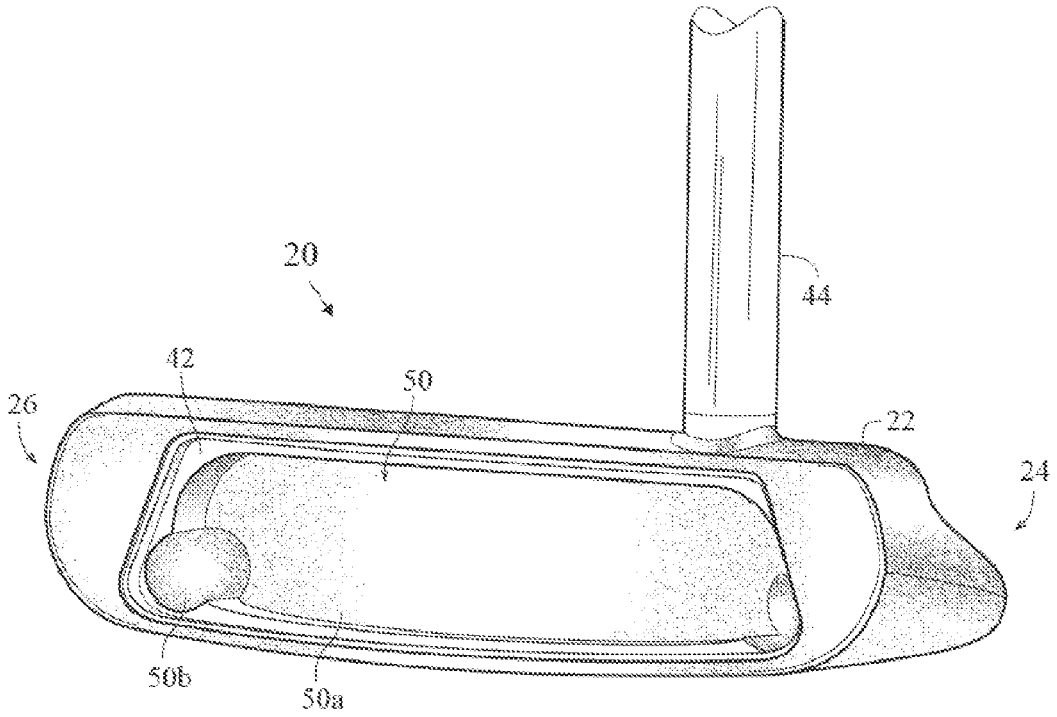
FIG. 9 is a front elevation view of an alternative embodiment putter-type golf club head with a sound chamber with a face insert removed to illustrate the sound chamber.
Figure 10:
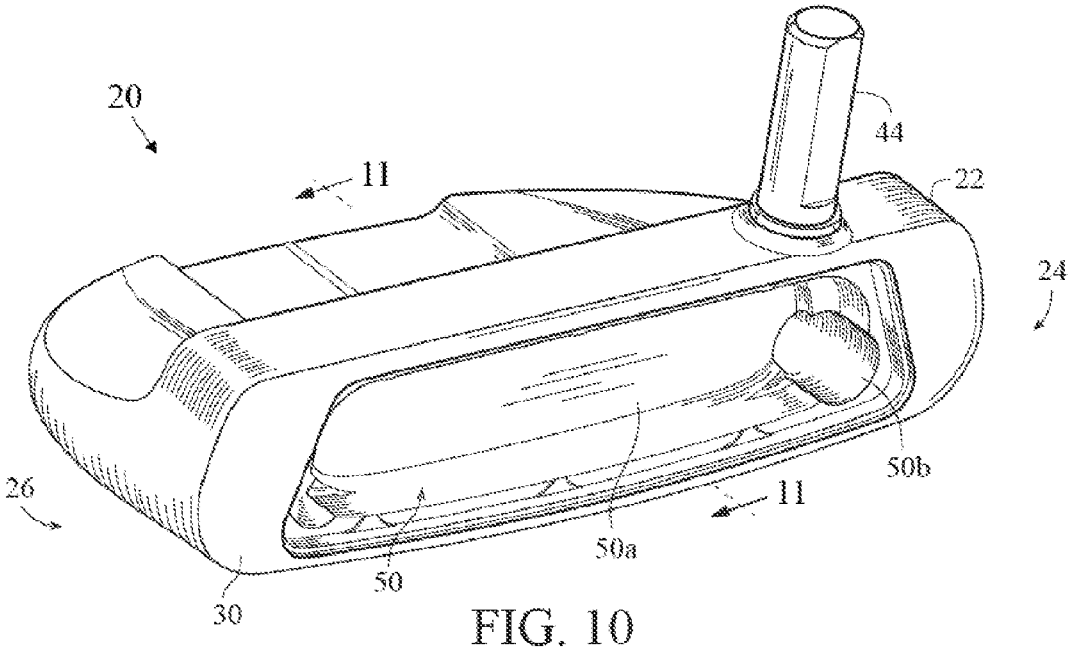
FIG. 10 is a top perspective view of an alternative embodiment putter-type golf club head with a sound chamber with a face insert removed to illustrate the sound chamber.
Figure 11:
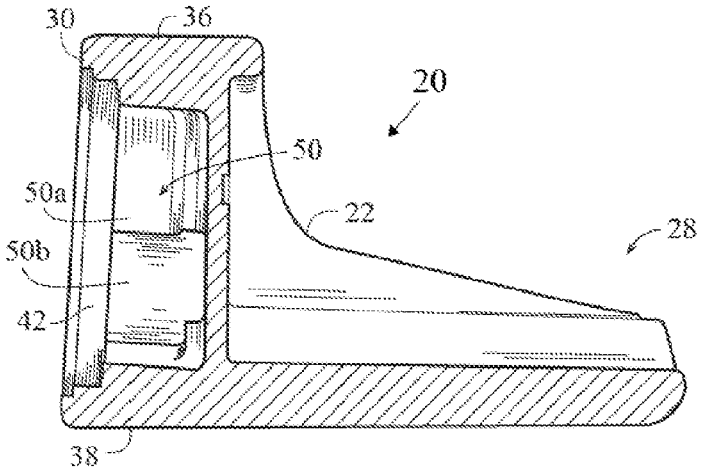
FIG. 11 is a cross-sectional view of a putter-type golf club head with a sound chamber along line 11-11 of FIG. 10.
Figure 12:
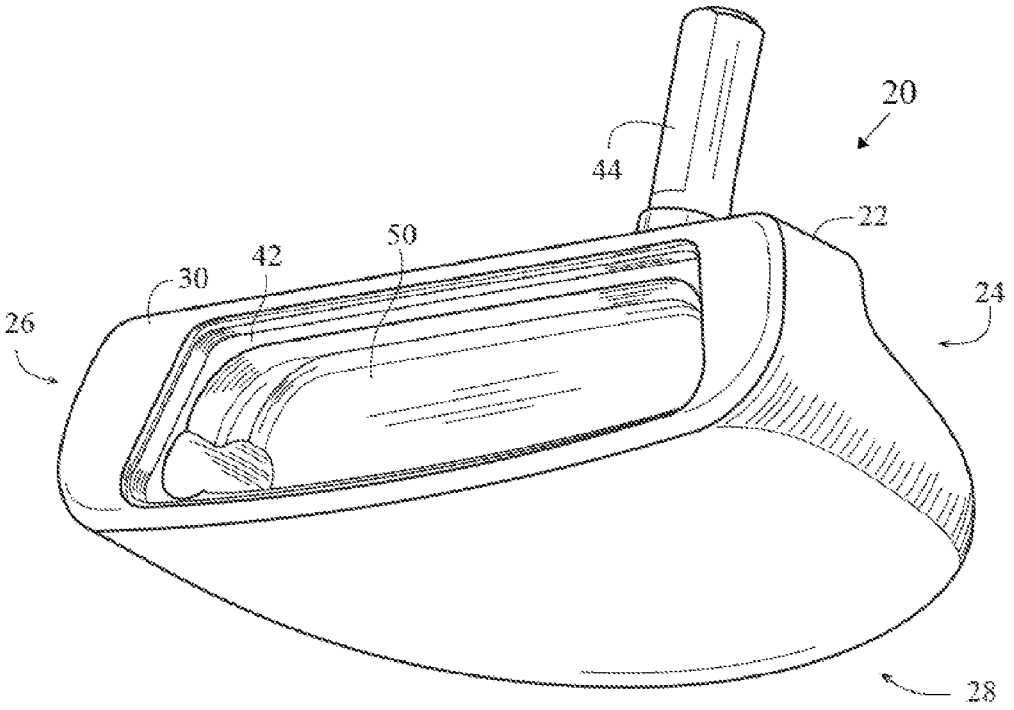
FIG. 12 is a bottom perspective view of an alternative embodiment putter-type golf club head with a sound chamber with a face insert removed to illustrate the sound chamber.
Figure 13:
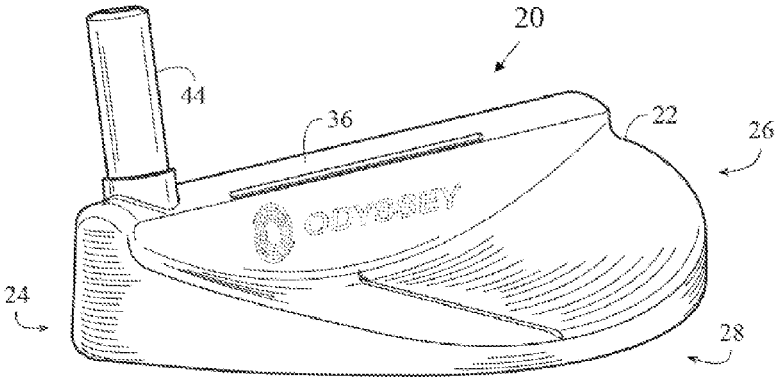
FIG. 13 is a rear view of an alternative embodiment putter-type golf club head with a sound chamber.
Figure 14:
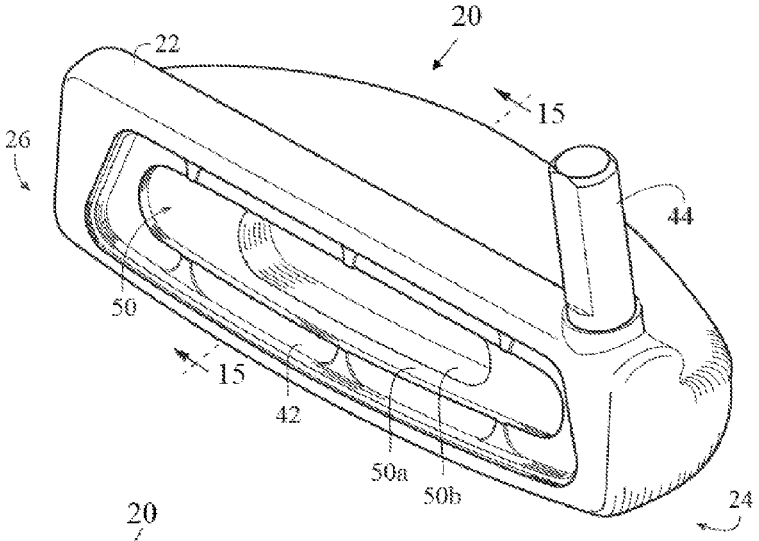
FIG. 14 is a top perspective view of an alternative embodiment putter-type golf club head with a sound chamber with a face insert removed to illustrate the sound chamber.
Figure 15:
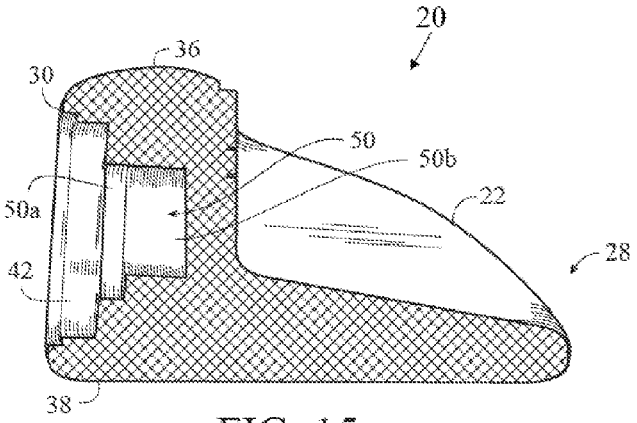
FIG. 15 is a cross-sectional view of a putter-type golf club head with a sound chamber along line 15-15 of FIG. 14.

FIGS. 9-11 illustrate an alternative embodiment of a putter-type golf club head 20 with a sound chamber 50. The body 22 comprises a heel end 24, a toe end 26, an aft end 28, a face portion 30, a crown portion 36 and a sole portion 38. A hosel 44 extends upward from a heel end 24 of the crown portion 36 of the body 22. The body 22 defines the sound chamber 50, which is adjacent to and communicates with an opening 42 in the face portion 30. The sound chamber 50 comprises a central sound sub-chamber 50*a* and an outer sound sub-chamber 50*b*. In this embodiment, the central sound sub-chamber 50*a* has a larger volume than the outer sound sub-chamber 50*b*. The body 22 preferably has a volume ranging from 2.3 cubic inches to 2.8 cubic inches, and most preferably has a volume of 2.41 cubic inches. The sound chamber 50 preferably has a volume ranging from 0.5 cubic inches to 0.95 cubic inches, and most preferably 0.81 cubic inches. This embodiment of the putter-type golf club head 20 preferably has a pitch of 2600 Hz, an amplitude of 62.5 dBA and a duration of 25 milli-seconds.

FIGS. 12-15 illustrate an alternative embodiment of a putter-type golf club head 20 with a sound chamber 50. The body 22 comprises a heel end 24, a toe end 26, an aft end 28, a face portion 30, a crown portion 36 and a sole portion 38. A hosel 44 extends upward from a heel end 24 of the crown portion 36 of the body 22. The body 22 defines the sound chamber 50, which is adjacent to and communicates with an opening 42 in the face portion 30. The sound chamber 50 comprises a central sound sub-chamber 50*b* and an outer sound sub-chamber 50*a*. In this embodiment, the central sound sub-chamber 50*b* has a larger volume than the outer sound sub-chamber 50*a*. The body 22 preferably has a volume ranging from 2.3 cubic inches to 2.8 cubic inches, and most preferably has a volume of 2.56 cubic inches. The sound chamber 50 preferably has a volume ranging from 0.5 cubic inches to 0.95 cubic inches, and most preferably 0.41 cubic inches. This embodiment of the putter-type golf club head 20 preferably has a pitch of 2400 Hz, an amplitude of 62.5 dBA and a duration of 45 milli-seconds.

Figure 16:
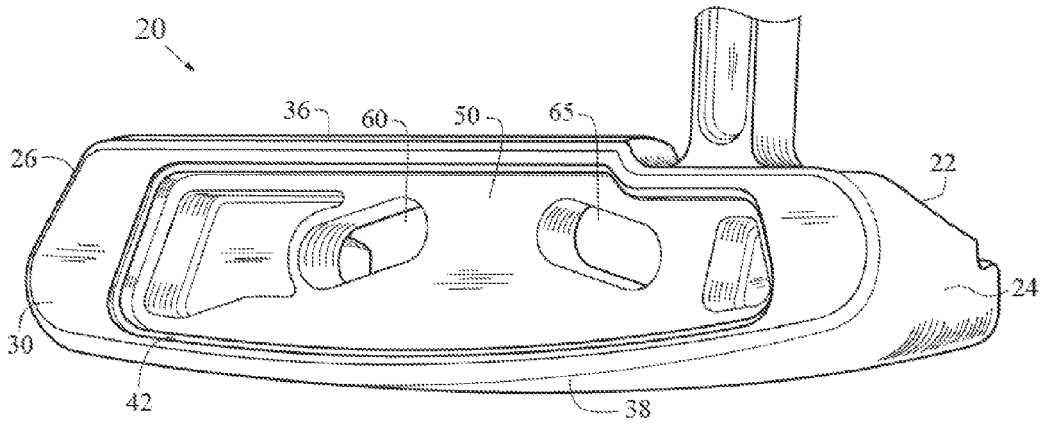
FIG. 16 is a front elevation view of an alternative putter-type golf club head with a sound chamber with its face insert removed to illustrate the sound chamber.
Figure 17:
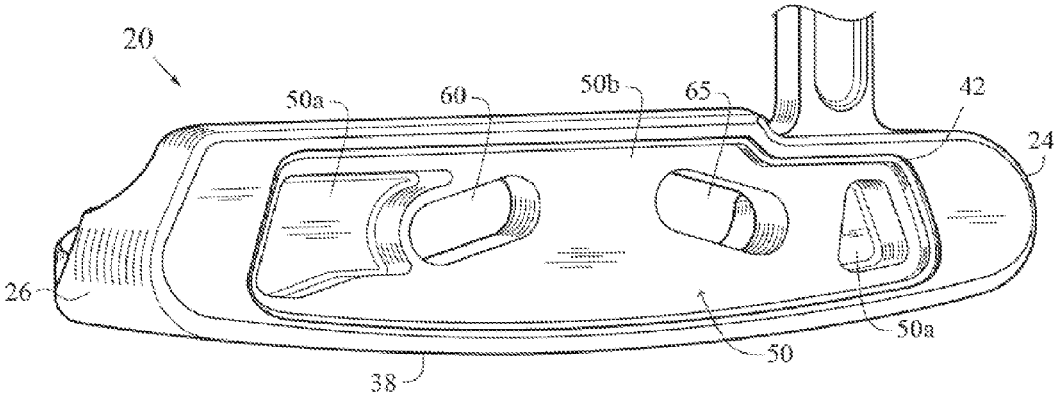
FIG. 17 is another front, elevation view of the putter-type golf club head shown in FIG. 16.
Figure 18:
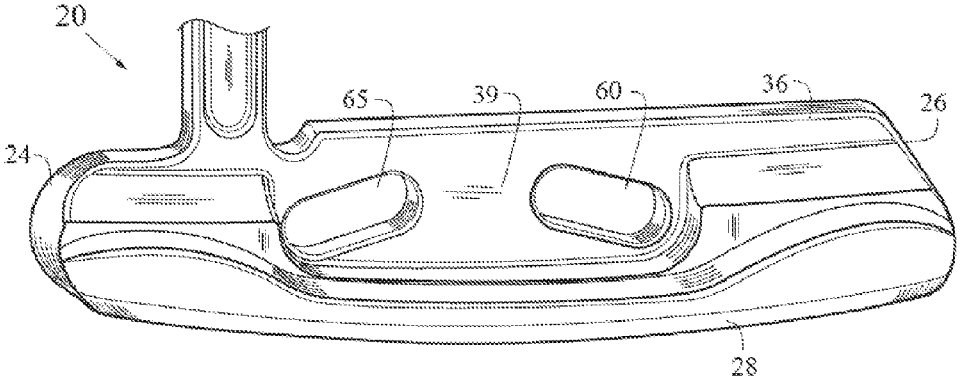
FIG. 18 is a rear elevation view of the putter-type golf club head shown in FIG. 16.

FIGS. 16-18 illustrate another embodiment of a putter-type golf club head 20 with a sound chamber 50. The body 22 comprises a heel end 24, a toe end 26, an aft end 28, a face portion 30, a crown portion 36 and a sole portion 38. A hosel 44 extends upward from a heel end 24 of the crown portion 36 of the body 22. The body 22 defines the sound chamber 50, which is adjacent to and communicates with an opening 42 in the face portion 30. The sound chamber 50 comprises a central sound sub-chamber 50*b* and two outer sound sub-chambers 50*a*. In this embodiment, the two outer sub-chambers 50*a* have different volumes and shapes from one another, while the center sound sub-chamber 50*b* is much shallower than other sub-chambers disclosed herein. This embodiment also includes a pair of through bores 60, 65 extending through the entire thickness of the body 22 from the central sound sub-chamber 50*b* to the rear side 39 of the face portion 30. These through-bores 60, 65 selectively amplify and improve the sound of the putter 10 when it strikes a golf ball 18. The through bores 60, 65 preferably have approximately oval shapes.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club head comprising:

a body comprising a heel end, a toe end, an aft end, a face portion, a crown portion and a sole portion, the body defining an opening in the face portion and a sound chamber disposed adjacent to, and in communication with, the opening; and a face insert positioned within the opening, the face insert comprising a first piece comprising a central recess extending into a striking surface of the first piece and a second piece disposed within the central recess, wherein the second piece is composed of a polymeric material and is configured to strike a golf ball, wherein no portion of the face insert is disposed within the sound chamber, wherein the sound chamber has a volume ranging from 0.25 cubic inch to 0.95 cubic inch, and wherein the body, the sound chamber, and the face insert amplify the sound generated by the golf club head striking a golf ball such that the golf club head has a pitch ranging from 2400 Hertz (Hz) to 2700 Hz and an amplitude ranging from 61.5 to 64.5 dBA.

2. The golf club head according to claim 1, wherein the sound chamber comprises a central sound sub-chamber and at least one outer sound sub-chamber, and wherein the central sound chamber has a depth that is shallower than a depth of the outer sound chamber.

3. The golf club head according to claim 2, wherein a volume of the central sound sub-chamber is greater than a volume of the outer sound sub-chamber.

4. The golf club head according to claim 1, wherein the body is composed of an iron alloy material.

5. The golf club head according to claim 4, wherein the first piece is composed of a metal material, and wherein the first piece is welded to the body.

6. The golf club head according to claim 1, wherein the face insert has a variable face thickness.

7. The golf club head according to claim 1, wherein the face insert has a return portion and a striking plate portion.

8. The golf club head according to claim 1, wherein the face insert has a cross-bar pattern with a thick cross bar and a plurality of thin sections, wherein a thickness of the cross bar is at least 0.03 inch greater than a thickness of each of the plurality of thin sections.

9. A golf club head comprising:

a body comprising a heel end, a toe end, an aft end, a face portion, a rear surface opposite the face portion, a crown portion, and a sole portion, the body defining a an opening in the face portion, a sound chamber disposed adjacent to, and in communication with, the opening, and at least one through bore extending from the sound chamber through the rear surface; and a face insert positioned within the opening, wherein no portion of the face insert is disposed within the sound chamber, wherein the body has a volume ranging from 2.3 cubic inches to 2.8 cubic inches, wherein the sound chamber has a volume ranging from 0.25 cubic inch to 0.95 cubic inch, and wherein the body, the sound chamber, the through bore, and the face insert amplify the sound generated by the golf club head striking a golf ball such that the golf club head has an amplitude ranging from 61.5 to 64.5 dBA and a duration ranging from 25 milliseconds to 45 milliseconds.

10. The golf club head according to claim 9, wherein the face insert comprises a first piece comprising a central recess extending into a striking surface of the first piece and a second piece configured to strike a golf ball disposed within the central recess.

11. The golf club head according to claim 10, wherein the first piece of the face insert is composed of a metal material, and wherein the first piece is welded to the body.

12. The golf club head according to claim 11, wherein the second piece of the face insert is composed of a polymeric material, and wherein the second piece is affixed to the first piece with an adhesive material.

13. The golf club head according to claim 9, wherein the body is composed of an iron alloy material.

14. The golf club head according to claim 9, wherein the at least one through bore comprises two through bores, and wherein each of the through bores has an approximately oval shape.

15. The golf club head comprising according to claim 9, wherein the face insert comprises a central section and a plurality of thin sections, and wherein a thickness of the central section is at least 0.03 inch greater than a thickness of each of the plurality of thin sections.

16. The golf club head according to claim 15, wherein the face insert has a return portion and a striking plate portion.

17. The golf club head according to claim 9, wherein the sound chamber comprises a central sound sub-chamber and at least first and second outer sound sub-chambers, and wherein the first and second outer sound sub-chambers have different volumes and shapes from one another.

18. The golf club head according to claim 17, wherein the central sound chamber has a depth that is shallower than a depth of at least one of the first and second outer sound chambers.

* * * * *